US005245025A

United States Patent [19]

Trokhan et al.

[11] Patent Number: 5,245,025

[45] Date of Patent: Sep. 14, 1993

[54] METHOD AND APPARATUS FOR MAKING CELLULOSIC FIBROUS STRUCTURES BY SELECTIVELY OBTURATED DRAINAGE AND CELLULOSIC FIBROUS STRUCTURES PRODUCED THEREBY

[75] Inventors: Paul D. Trokhan, Hamilton; Dean Van Phan; Larry L. Huston, both of West Chester, all of Ohio

[73] Assignee: The Procter & Gamble Company, Cincinnati, Ohio

[21] Appl. No.: 722,792

[22] Filed: Jun. 28, 1991

[51] Int. Cl.[5] ..... C08B 37/00

[52] U.S. Cl. ..... 536/56

[58] Field of Search ..... 536/56

[56] References Cited

U.S. PATENT DOCUMENTS

| | | | |
|---|---|---|---|
| 1,699,760 | 1/1929 | Sherman | 162/195 |
| 2,862,251 | 12/1958 | Kalwaites | 264/119 |
| 2,902,395 | 9/1959 | Hirschy et al. | 428/108 |
| 3,034,180 | 5/1962 | Greiner et al. | 19/301 |
| 3,072,511 | 1/1963 | Harwood | 428/284 |
| 3,081,500 | 3/1963 | Griswold et al. | 264/119 |
| 3,081,512 | 3/1963 | Griswold | 264/119 |
| 3,081,514 | 5/1963 | Griswold | 428/288 |
| 3,081,515 | 5/1963 | Griswold et al. | 428/131 |
| 3,491,802 | 1/1970 | Mortensen et al. | 139/420 R |
| 3,681,182 | 8/1972 | Kalwaites | 128/131 |
| 3,681,183 | 8/1972 | Kalwaites | 428/131 |
| 3,881,987 | 5/1975 | Benz | 162/116 |
| 4,191,609 | 3/1980 | Trokhan | 162/113 |
| 4,840,829 | 6/1989 | Suzuki et al. | 428/131 |

FOREIGN PATENT DOCUMENTS

| | | |
|---|---|---|
| 0490655A1 | 6/1992 | European Pat. Off. . |
| WO91/02642 | 3/1991 | World Int. Prop. O. . |

OTHER PUBLICATIONS

Veratec Sales Presentation by Zoltan Mate, May 8, 1991-Wet Laid Hydroentangled Formation.

*Primary Examiner*—John Kight, III
*Assistant Examiner*—Jeffrey Culpoper Mullis
*Attorney, Agent, or Firm*—Larry L. Huston; Fredrick H. Braun

[57] ABSTRACT

Disclosed herein is a cellulosic fibrous structure having multiple regions distinguished from one another by basis weight. The structure is a paper having an essentially continuous high basis weight network, and discrete regions of low basis weight which circumscribe discrete regions of intermediate basis weight. The cellulosic fibers forming the low basis weight regions may be radially oriented relative to the centers of the regions. The paper may be formed by using a forming belt having zones with different flow resistances. The basis weight of a region of the paper is generally inversely proportional to the flow resistance of the zone of the forming belt, upon which such region was formed. The zones of different flow resistances provide for selectively draining a liquid carrier having suspended cellulosic fibers through the different zones of the forming belt.

8 Claims, 3 Drawing Sheets

METHOD AND APPARATUS FOR MAKING CELLULOSIC FIBROUS STRUCTURES BY SELECTIVELY OBTURATED DRAINAGE AND CELLULOSIC FIBROUS STRUCTURES PRODUCED THEREBY

FIELD OF THE INVENTION

The present invention relates to a method and apparatus for producing a cellulosic fibrous structure having regions of multiple basis weights and, more particularly, having multiple basis weight regions with a high basis weight region comprising an essentially continuous network. Such a cellulosic fibrous structure is typically executed in a paper having three or more regions discriminated from one another by basis weight.

BACKGROUND OF THE INVENTION

Cellulosic fibrous structures, such as paper, are well-known in the art. Such fibrous structures are in common use today for paper towels, toilet tissue, facial tissue, etc. To meet the needs of the consumer, these cellulosic fibrous structures must balance several competing interests. For example, the cellulosic fibrous structure must have a sufficient tensile strength to prevent the cellulosic fibrous structure from tearing or shredding during ordinary use or when undue tensile forces are not applied. The cellulosic fibrous structure must also be absorbent, so that liquids may be quickly absorbed and fully retained by the cellulosic fibrous structure. The cellulosic fibrous structure should also exhibit sufficient softness, so that it is tactilely pleasing and not harsh during use. The fibrous structure should exhibit a high degree of opacity, so that it does not appear flimsy or of low quality to the user. Against this backdrop of competing interests, the cellulosic fibrous structure must be economical, so that it can be manufactured and sold for a profit, and yet is affordable to the consumer.

Tensile strength, one of the aforementioned properties, is the ability of the fibrous structure to retain its physical integrity during use. Tensile strength is controlled by the weakest link under tension in the cellulosic fibrous structure. The cellulosic fibrous structure will exhibit no greater tensile strength than that of any region in the cellulosic fibrous structure which is undergoing a tensile loading, as the cellulosic fibrous structure will fracture or tear through such weakest region.

The tensile strength of a cellulosic fibrous structure may be improved by increasing the basis weight of the cellulosic fibrous structure. However, increasing the basis weight requires more cellulosic fibers to be utilized in the manufacture, leading to greater expense and requiring greater utilization of natural resources for the raw materials.

Absorbency is the property of the cellulosic fibrous structure which allows it to attract and retain contacted liquids. Both the absolute quantity of liquid retained and the rate at which the fibrous structure absorbs contacted liquids must be considered with respect to the desired end use of the cellulosic fibrous structure. Absorbency is influenced by the density of the cellulosic fibrous structure. If the cellulosic fibrous structure is too dense, the interstices between fibers may be too small and the rate of absorption may not be great enough for the intended use. If the interstices are too large, capillary attraction of contacted liquids is minimized and, due to surface tension limitations, liquids will not be retained by the fibrous structure.

Softness is the ability of a cellulosic fibrous structure to impart a particularly desirable tactile sensation to the user's skin. Softness is influenced by bulk modulus (fiber flexibility, fiber morphology, bond density and unsupported fiber length), surface texture (crepe frequency, size of various regions and smoothness), and the stick-slip surface coefficient of friction. Softness is inversely proportional to the ability of the cellulosic fibrous structure to resist deformation in a direction normal to the plane of the cellulosic fibrous structure.

Opacity is the property of a cellulosic fibrous structure which prevents or reduces light transmission therethrough. Opacity is directly related to the basis weight, density and uniformity of fiber distribution of the cellulosic fibrous structure. A cellulosic fibrous structure having relatively greater basis weight or uniformity of fiber distribution will also have greater opacity for a given density. Increasing density will increase opacity to a point, beyond which further densification will decrease opacity.

One compromise between the various aforementioned properties is to provide a cellulosic fibrous structure having mutually discrete zero basis weight apertures amidst an essentially continuous network having a particular basis weight. The discrete apertures represent regions of lower basis weight than the essentially continuous network providing for bending perpendicular to the plane of the cellulosic fibrous structure, and hence increase the flexibility of the cellulosic fibrous structure. The apertures are circumscribed by the continuous network, which has a desired basis weight and which controls the tensile strength of the fibrous structure.

Such cellulosic structures are known in the prior art. For example, U.S. Pat. No. 3,034,180 issued May 15, 1962 to Greiner et al. discloses cellulosic fibrous structures having bilaterally staggered apertures and aligned apertures. Moreover, cellulosic fibrous structures having various shapes of apertures are disclosed in the prior art. For example, Greiner et al. discloses square apertures, diamond-shaped apertures, round apertures and cross-shaped apertures.

However, apertured cellulosic fibrous structures have several shortcomings. The apertures represent transparencies in the cellulosic fibrous structure and may cause the consumer to feel the structure is of lesser quality or strength than desired. The apertures are generally too large to absorb and retain any liquids, due to the limited surface tension of liquids typically encountered by the aforementioned tissue and towel products. Also, the basis weight of the network around the apertures must be increased so that sufficient tensile strength is obtained.

In addition to the zero basis weight apertured degenerate case, attempts have been made to provide a cellulosic fibrous structure having mutually discrete nonzero low basis weight regions amidst an essentially continuous network. For example, U.S. Pat. 4,514,345 issued Apr. 30, 1985 to Johnson et al. discloses a fibrous structure having discrete nonzero low basis weight hexagonally shaped regions. A similarly shaped pattern, utilized in a textile fabric, is disclosed in U.S. Pat. 4,144,370 issued Mar. 13, 1979 to Boulton.

The nonapertured structures disclosed in these references provide the advantages of slightly increased opacity and the presence of some absorbency in the discrete low basis weight regions, but do not solve the problem that very little tensile load is carried by the discrete nonzero low basis weight regions, thus limiting the overall burst strength of the cellulosic fibrous structure. Also, neither Johnson et al. nor Boulton teach cellulosic fibrous structures having relatively high opacity in the discrete low basis weight regions.

Cellulosic fibrous structures are usually manufactured by depositing a liquid carrier having cellulosic fibers homogeneously entrained therein onto an apparatus having a fiber retentive liquid pervious forming element. The forming element may be generally planar and is typically an endless belt.

The aforementioned references, and additional teachings such as U.S. Pat. No. 3,322,617 issued May 30, 1967 to Osborne; U.S. Pat. No. 3,025,585 issued Mar. 20, 1962 to Griswold, and U.S. Pat. No. 3,159,530 issued Dec. 1, 1964 to Heller et al. disclose various apparatuses suitable for manufacturing cellulosic fibrous structures having discrete low basis weight regions. The discrete low basis weight regions according to these teachings are produced by a pattern of upstanding protuberances joined to the forming element of the apparatus used to manufacture the cellulosic fibrous structure. However, in each of the aforementioned references, the upstanding protuberances are disposed in a regular, repeating pattern. The pattern may comprise protuberances staggered relative to the adjacent protuberances or aligned with the adjacent protuberances. Each protuberance (whether aligned, or staggered) is equally spaced from the adjacent protuberance. Indeed, Heller et al. utilizes a woven Fourdrinier wire for the protuberances.

The arrangement of equally spaced protuberances represents another shortcoming in the prior art. The apparatuses having this arrangement provide substantially uniform and equal flow resistances (and hence drainage and hence deposition of cellulosic fibers) throughout the entire liquid pervious portion of the forming element utilized to make the cellulosic fibrous structure. Substantially equal quantities of cellulosic fibers are deposited in the liquid pervious region because equal flow resistances to the drainage of the liquid carrier are present in the spaces between adjacent protuberances. Thus, fibers will be relatively homogeneously and uniformly deposited, although not necessarily randomly or uniformly aligned, in each region of the apparatus and will form a cellulosic fibrous structure having a like distribution and alignment of fibers.

One teaching in the prior art not to have each protuberance equally spaced from the adjacent protuberances is disclosed in U.S. Pat. No. 795,/719 issued Jul. 25, 1905 to Motz. However, Motz discloses protuberances disposed in a generally random pattern which does not advantageously distribute the cellulosic fibers in the manner most efficient to maximize any one of or optimize a majority of the aforementioned properties.

Accordingly, it is an object of this invention to overcome the problems of the prior art and particularly to overcome the problems presented by the competing interests of maintaining high tensile strength, high absorbency, high softness, and high opacity without unduly sacrificing any of the other properties or requiring an uneconomical or undue use of natural resources. Specifically, it is an object of this invention to provide a method and apparatus for producing a cellulosic fibrous structure, such as paper, by having multiple and different flow resistances to the drainage of the liquid carrier of the fibers in the apparatus.

By having regions of relatively high and relatively low resistance to flow present in the apparatus, one can achieve greater control over the orientation and pattern of deposition of the cellulosic fibers, and obtain fibrous structures not heretofore known in the art. Generally, there in an inverse relation between the flow resistance of a particular region of the liquid pervious fiber retentive forming element and the basis weight of the region of the resulting cellulosic fibrous structure corresponding to such regions of the forming element. Thus, regions of relatively low flow resistance will produce corresponding regions in the cellulosic fibrous structure having a relatively high basis weight and vice versa.

More particularly, the regions of relatively low flow resistance should be continuous so that a continuous high basis weight network of fibers results, and tensile strength is not sacrificed. The regions of relatively high flow resistance (which yield relatively low basis weight regions in the cellulosic fibrous structure) may either be discrete or continuous, as desired.

According to the present invention, the forming element is a forming belt having a plurality of regions discriminated from one another by having different flow resistances. The liquid carrier drains through the regions of the forming belt according to and inversely proportional to the flow resistance presented thereby. For example, if there are impervious regions, such as protuberances or blockages in the forming belt, no liquid carrier can drain through these regions and hence relatively few or no fibers will be deposited in such regions.

The flow resistance of the forming belt according to the present invention is thus critical to determining the pattern in which the cellulosic fibers entrained in the liquid carrier will be deposited. Generally, more fibers will be deposited in zones of the forming belt having a relatively lesser flow resistance, because more liquid carrier may drain through such regions. However, it is to be recognized that the flow resistance of a particular region on the forming belt is not constant and will change as a function of time.

Such change occurs because as the cellulosic fibers are deposited onto a region of the forming belt the cellulosic fibers will obturate the region, increasing its flow resistance. Obturation and increased flow resistance in a region result in generally reducing the amount liquid carrier which drains therethrough and, hence, the amount of fibers later and further deposited onto this same region.

BRIEF SUMMARY OF THE INVENTION

The invention comprises a single lamina cellulosic fibrous structure having at least three regions disposed in a nonrandom repeating pattern. The first region is of relatively high basis weight compared to the other two regions and comprises an essentially continuous network which circumscribes the other two regions. The second region is of relatively low basis weight compared to the two other regions and is circumscribed by the first region. The third region is of intermediate basis weight relative to the two other regions and is juxtaposed with the second region, peripherally bordering it. Particularly, the second region may be substantially contiguous with the third region, more particularly may circumscribe the third region, and may even be circumjacent the third region. In a preferred embodiment, a plurality of the cellulosic fibers of the second region are substantially radially oriented.

The cellulosic fibrous structure according to the present invention may be made according to the process of depositing a liquid carrier having cellulosic fibers suspended therein onto a liquid pervious fiber retentive forming element. The liquid carrier drains through the forming element in two simultaneous stages, a high flow rate stage and a low flow rate stage, corresponding respectively to the high and low flow rate zones in the forming belt. Both stages decrease in flow rate as a function of time, due to obturation of the zones with cellulosic fibers. The stages are discriminated from one another by the initial mass flow rate through the respective zones.

The cellulosic fibrous structure according to the present invention may be made on an apparatus comprising a liquid pervious fiber retentive forming element. The forming element has two zones, a high flow rate zone and a low flow rate zone. The belt also has protuberances which are impervious to the flow of liquid carrier therethrough. The protuberances and the two zones are arranged in a pattern corresponding to the basis weights of the regions of the cellulosic fibrous structure to be formed thereon. The forming element may have a means for retaining cellulosic fibers in a pattern of three different basis weights. The means for retaining cellulosic fibers in a pattern may comprise zones in the forming element having different hydraulic radii.

The hydraulic radii of the zones may be made different by having a patterned array of upstanding protuberances in the forming element, by each protuberance being equally spaced from the adjacent protuberance and having a liquid pervious orifice therethrough by having protuberances clustered so that some protuberances are equally spaced from the adjacent protuberances and some protuberances are not equally spaced from the adjacent protuberances, or by combinations of the foregoing.

BRIEF DESCRIPTION OF THE DRAWINGS

While the Specification concludes with claims particularly pointing out and distinctly claiming the present invention, it is believed the same will be better understood by the following Specification taken in conjunction with the associated drawings in which like components are given the same reference numeral, analogous components are designated with a prime symbol and:

DETAILED DESCRIPTION OF THE INVENTION

The Product

Figure 1:
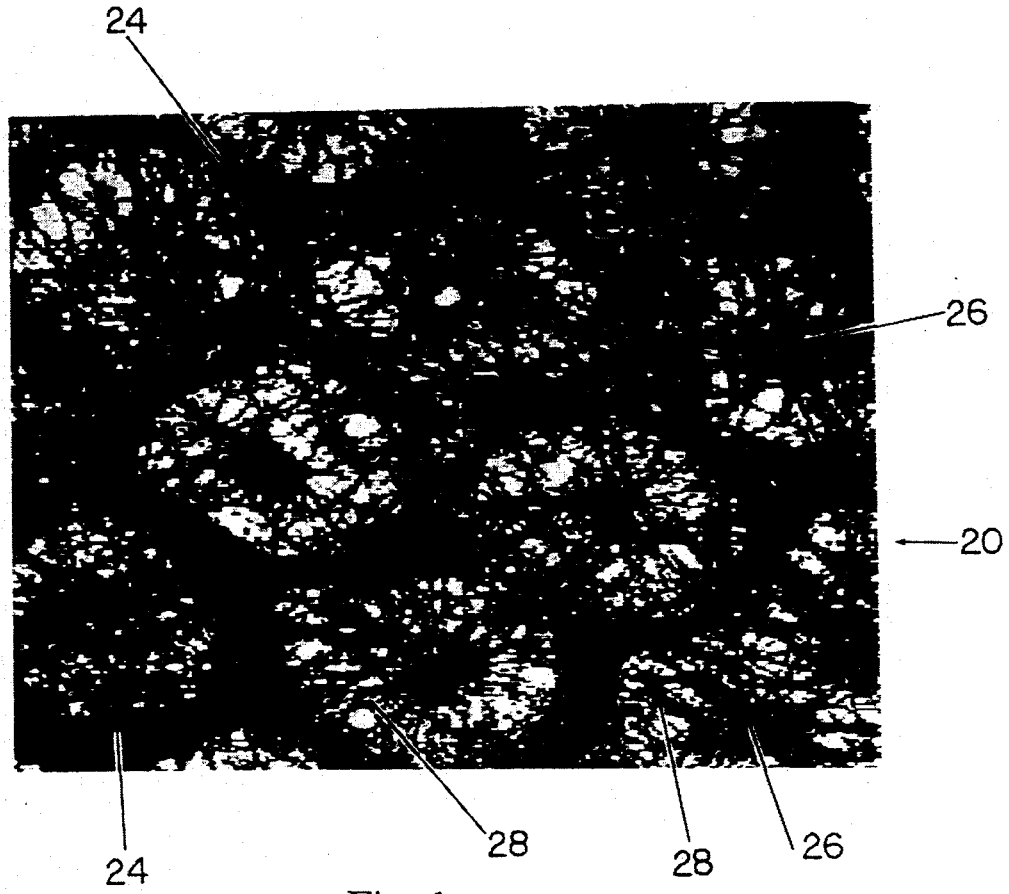
FIG. 1 is top plan photomicrographic view of a cellulosic fibrous structure according to the present invention having three mutually distinguishable regions.

As illustrated in FIG. 1, a cellulosic fibrous structure 20 according to the present invention has three regions: first high basis weight regions 24; second intermediate basis weight regions 26; third low basis weight regions 28. Each region 24, 26 or 28 is composed of fibers which are approximated by linear elements.

The fibers are components of the cellulosic fibrous structure 20 and have one very large dimension (along the longitudinal axis of the fiber) compared to the other two relatively very small dimensions (mutually perpendicular, and being both radial and perpendicular to the longitudinal axis of the fiber), so that linearity is approximated. While microscopic examination of the fibers may reveal two other dimensions which are small, compared to the principal dimension of the fibers, such other two small dimensions need not be substantially equivalent nor constant throughout the axial length of the fiber. It is only important that the fiber be able to bend about its axis, be able to bond to other fibers and be distributed by a liquid carrier.

The fibers comprising the cellulosic fibrous structure may be synthetic, such as polyolefin or polyester; are preferably cellulosic, such as cotton linters, rayon or bagasse; and more preferably are wood pulp, such as soft woods (gymnosperms or coniferous) or hard woods (angiosperms or deciduous). As used herein, a fibrous structure 20 or is considered "cellulosic" if the fibrous structure 20 or comprises at least about 50 weight percent or at least about 50 volume percent cellulosic fibers, including but not limited to those fibers listed above. A cellulosic mixture of wood pulp fibers comprising softwood fibers having a length of about 2.0 to about 4.5 millimeters and a diameter of about 25 to about 50 micrometers, and hardwood fibers having a length of less than about 1 millimeter and a diameter of about 12 to about 25 micrometers has been found to work well for the cellulosic fibrous structures 20 described herein.

If wood pulp fibers are selected for the cellulosic fibrous structure 20, the fibers may be produced by any pulping process including chemical processes, such as sulfite, sulphate and soda processes; and mechanical processes such as stone groundwood. Alternatively, the fibers may be produced by combinations of chemical and mechanical processes or may be recycled. The type, combination, and processing of the fibers used are not critical to the present invention.

It is not necessary, or even likely, that the various regions 24, 26 and 28 of the cellulosic fibrous structure 20 have the same or a uniform distribution of hardwood and softwood fibers. Instead, it is likely that regions 24, 26 or 28 formed by a zone of the apparatus used to make the cellulosic fibrous structure 20 having a lesser flow resistance will have a greater percentage of softwood fibers. Furthermore, the hardwood and softwood fibers may be layered throughout the thickness of the cellulosic fibrous structure 20.

A cellulosic fibrous structure 20 according to the present invention is macroscopically two-dimensional and planar, although not necessarily flat. The cellulosic fibrous structure 20 may have some thickness in the third dimension. However, the third dimension is very small compared to the actual first two dimensions or to the capability to manufacture a cellulosic fibrous structure 20 having relatively large measurements in the first two dimensions.

The cellulosic fibrous structure 20 according to the present invention comprises a single lamina. However, it is to be recognized that two or more single laminae, any or all made according to the present invention, may be joined in face-to-face relation to form a unitary laminate. A cellulosic fibrous structure 20 according to the present invention is considered to be a "single lamina" if it is taken off the forming element, discussed below, as a single sheet having a thickness prior to drying which does not change unless fibers are added to or removed from the sheet. The cellulosic fibrous structure 20 may be later embossed, or remain nonembossed, as desired.

The cellulosic fibrous structure 20 according to the present invention may be defined by intensive properties which discriminate regions 24, 26 and 28 from each other. For example, the basis weight of the fibrous structure 20 is one intensive property which discriminates the regions 24, 26 and 28 from each other. As used herein, a property is considered "intensive" if it does not have a value dependent upon the aggregation of values within the plane of the cellulosic fibrous structure 20. Examples of intensive properties include the density, projected capillary size, basis weight, temperature, compressive and tensile moduli, etc. of the cellulosic fibrous structure 20. As used herein properties which depend upon the aggregation of various values of subsystems or components of the cellulosic fibrous structure 20 are considered "extensive." Examples of extensive properties include the weight, mass, volume, and moles of the cellulosic fibrous structure 20.

The cellulosic fibrous structure 20 according to the present invention has at least three distinct basis weights which are divided between at least three identifiable areas, referred to as "regions" of the fibrous structure 20. As used herein, the "basis weight" is the weight, measured in grams force, of a unit area of the cellulosic fibrous structure 20, which unit area is taken in the plane of the cellulosic fibrous structure 20. The size and shape of the unit area from which the basis weight is measured is dependent upon the relative and absolute sizes and shapes of the regions 24, 26, and 28 having the different basis weights.

It will be recognized by one skilled in the art that within a given region 24, 26, or 28, ordinary and expected basis weight fluctuations and variations may occur, when such given region 24, 26 or 28 is considered to have one basis weight. For example, if on a microscopic level, the basis weight of an interstice between fibers is measured, an apparent basis weight of zero will result when, in fact, unless an aperture in the fibrous structure 20 is being measured, the basis weight of such region 24, 26 or 28 is greater than zero. Such fluctuations and variations are a normal and expected result of the manufacturing process.

It is not necessary that exact boundaries divide adjacent regions 24, 26, or 28 of different basis weights, or that a sharp demarkation between adjacent regions 24, 26, or 28 of different basis weights be apparent at all. It is only important that the distribution of fibers per unit area be different in different positions of the fibrous structure 20 and that such different distribution occurs in a nonrandom, repeating pattern. Such nonrandom repeating pattern corresponds to a nonrandom repeating pattern in the topography of the liquid pervious fiber retentive forming element used to manufacture the cellulosic fibrous structure 20.

The different basis weights of the regions 24, 26 and 28 provide for different opacities of such regions 24, 26 and 28. While it is desirable from an opacity standpoint to have a uniform basis weight throughout the cellulosic fibrous structure 20, a uniform basis weight cellulosic fibrous structure 20 does not optimize other properties of the cellulosic fibrous structure 20, such as the wet burst strength. However, for the cellulosic fibrous structures 20 described herein, it is to be generally understood that regions 24 of relatively higher basis weight have greater opacity than regions having a lesser basis weight, such as intermediate basis weight regions 26 or low basis weight regions 28.

Preferably, the nonrandom repeating pattern tesselates, so that adjacent regions 24, 26 and 28 are cooperatively and advantageously juxtaposed. By being "nonrandom," the intensively defined regions 24, 26, and 28 are considered to be predictable, and may occur as a result of known and predetermined features of the apparatus used in the manufacturing process. By "repeating" the pattern is formed more than once in the fibrous structure 20.

The intensively discriminated regions 24, 26, and 28 of the fibrous structure 20 may be "discrete," so that adjacent regions 24, 26 or 28 having the same basis weight are not contiguous. Alternatively, a region 24, 26 or 28 having one basis weight throughout the entirety of the fibrous structure 20 may be "essentially continuous," so that such region 24, 26 or 28 extends substantially throughout the fibrous structure 20 in one or both of its principal dimensions.

Of course, it is to be recognized that if the fibrous structure 20 is very large as manufactured, and the regions 24, 26, and 28 are very small compared to the size of the fibrous structure 20 during manufacture, i.e. varying by several orders of magnitude, absolute predictability of the exact dispersion and patterns among the various regions 24, 26, and 28 may be very difficult or even impossible and yet the pattern still be considered nonrandom. However, it is only important that such intensively defined regions 24, 26, and 28 be dispersed in a pattern substantially as desired to yield the performance properties which render the fibrous structure 20 suitable for its intended purpose.

It will be apparent to one skilled in the art that there may be small transition regions having a basis weight intermediate the basis weights of the adjacent regions 24, 26, or 28, which transition regions by themselves may not be significant enough in area to be considered as comprising a basis weight distinct from the basis weights of either adjacent region 24, 26, or 28. Such transition regions are within the normal manufacturing variations known and inherent in producing a fibrous structure 20 according to the present invention.

The size of the pattern of the fibrous structure 20 may vary from about 1.5 to about 390 discrete regions 26 per square centimeter (from 10 to 2,500 discrete regions 26 per square inch), preferably from about 11.6 to about 155 discrete regions 26 per square centimeter (from 75 to 1,000 discrete regions 26 per square inch), and more preferably from about 23.3 to about 85.3 discrete regions 26 per square centimeter (from 150 to 550 discrete regions 26 per square inch).

It will be apparent to one skilled in the art that as the pattern becomes finer (having more discrete regions 24, 26 or 28 per square centimeter) a relatively larger percentage of the smaller sized hardwood fibers may be utilized, and the percentage of the larger sized softwood fibers may be correspondingly reduced. If too many larger sized fibers are utilized, such fibers may not be able to conform to the topography of the apparatus, described below, which produces the fibrous structure 20. If the fibers do not properly conform, such fibers may bridge various topographical regions of the apparatus, leading to a nonpatterned fibrous structure 20. A mixture comprising about 60 percent northern softwood kraft fibers and about 40 percent hardwood kraft fibers has been found to work well for a fibrous structure 20 having about 31 discrete regions per square centimeter (200 discrete regions 26 per square inch).

If the fibrous structure 20 illustrated in FIG. 1 is to be used as a consumer product, such as a paper towel or a tissue, the high basis weight region 24 of the fibrous structure 20 is preferably essentially continuous in two orthogonal directions within the plane of the fibrous structure 20. It is not necessary that such orthogonal directions be parallel and perpendicular the edges of the finished product or be parallel and perpendicular the direction of manufacture of the product, but only that tensile strength be imparted to the cellulosic fibrous structure in two orthogonal directions, so that any applied tensile loading may be more readily accommodated without premature failure of the product due to such tensile loading. Preferably, the continuous direction is parallel the direction of expected tensile loading of the finished product according to the present invention.

The cellulosic fibrous structure 20 according to the present invention comprises three regions, first high basis weight regions 24, second intermediate basis weight regions 26, and third low basis weight regions 28, as noted above. The regions 24, 26 and 28 are disposed in a nonrandom repeating pattern described more particularly as follows.

An example of an essentially continuous network is the high basis weight region 24 of the cellulosic fibrous structure 20 of FIG. 1. Other examples of cellulosic fibrous structures having essentially continuous networks are disclosed in U.S. Pat. No. 4,637,859 issued Jan. 20, 1987 to Trokhan and incorporated herein by reference for the purpose of showing another cellulosic fibrous structure having an essentially continuous network. Interruptions in the essentially continuous network are tolerable, albeit not preferred, so long as such interruptions do not substantially adversely affect the material properties of such portion of the cellulosic fibrous structure 20.

Conversely, the low and intermediate basis weight regions 26 and 28 may be discrete and dispersed throughout the high basis weight essentially continuous network 24. The low and intermediate basis weight regions 28 and 26 may be thought of as islands which are surrounded by a circumjacent essentially continuous network high basis weight region 24. The discrete low basis weight regions 28 and the discrete intermediate basis weight regions 26 also form a nonrandom, repeating pattern.

The discrete low basis weight regions 28 and the discrete intermediate basis weight regions 26 may be staggered in, or may be aligned in, either or both of the aforementioned two orthogonal directions. Preferably, the high basis weight essentially continuous network 24 forms a patterned network circumjacent the discrete low basis weight regions 28, although, as noted above, small transition regions may be accommodated.

The high basis weight regions 24 are adjacent, contiguous and circumscribe the low and intermediate basis weight regions 26 and 28. The intermediate basis weight regions 26 are juxtaposed with the low basis weight regions 28. The low basis weight regions 28 may peripherally border, but not fully circumscribe the intermediate basis weight region 26 or the low basis weight regions 28 may circumscribe the intermediate basis weight regions 26. Thus, the intermediate basis weight regions 26 are generally smaller in diametrical dimension, although not necessarily in surface area, than the circumjacent low basis weight regions 28.

The low basis weight regions 28 may further be contiguous and even circumjacent the intermediate basis weight regions 26. The relative disposition of the low and intermediate basis weight regions 26 within the high basis weight regions 24 depends upon the disposition of the high and low flow flow rate stage zones zones of different flow resistances in the forming belt 42. The low basis weight regions 29 may be apertures and represent holes in the cellulosic fibrous structure 20, if it is manufactured by the forming belt 42 embodied in FIG. 5. Alternatively, the low basis weight regions 28 may simply represent a region having fewer fibers per unit area but not be apertured, if it is manufactured by the forming belt 42 embodied by FIGS. 3–4.

The fibers of the three regions 24, 26 and 28 may be advantageously aligned in different directions. For example, the fibers comprising the essentially continuous high basis weight region 24 may be preferentially aligned in a generally singular direction, corresponding to the essentially continuous network of the annuluses 65 between adjacent protuberances 59 and the influence of the machine direction of the manufacturing process.

This alignment provides for fibers to be generally mutually parallel, have a relatively high degree of bonding. The relatively high degree of bonding produces a relatively high tensile strength in the high basis weight region 24. Such high tensile strength in the relatively high basis weight region 24 is generally advantageous, because the high basis weight region 24 carries and transmits applied tensile loading throughout the cellulosic fiber structure 20.

The relatively low basis weight region 28 comprises fibers, a plurality of which are generally radially oriented, and emanate outwardly from the center of the low basis weight region 28. If the low basis weight region 28 is circumjacent the intermediate basis weight region 26, the fibers of the low basis weight region will also be radially outwardly oriented with respect to the center of the intermediate basis weight region 26. Further, as illustrated in FIG. 1, the low basis weight region 28 and the intermediate basis weight region 26 may be and preferably are mutually concentric.

The Apparatus

Figure 2:
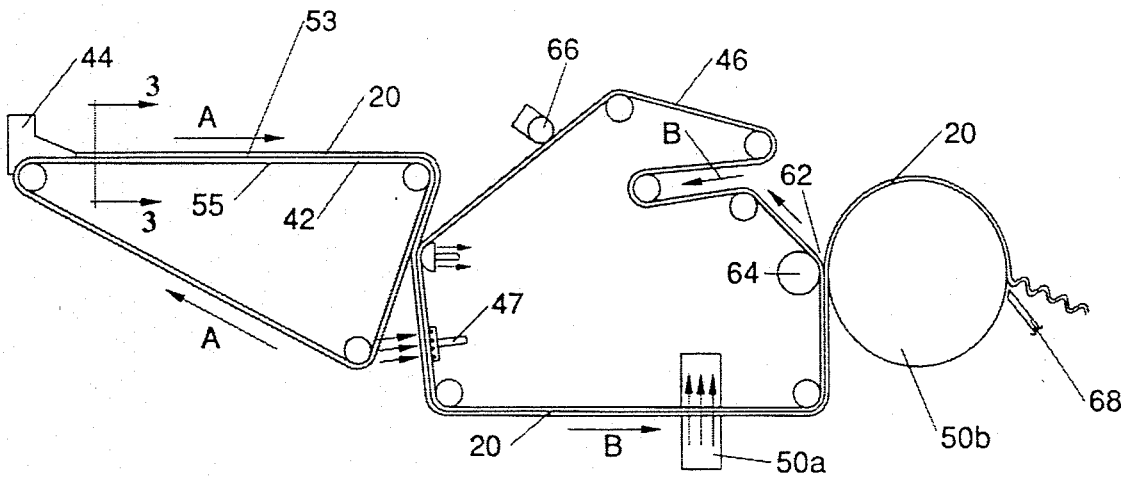
FIG. 2 is a schematic side elevational view of an apparatus which may be utilized to make the cellulosic fibrous structure according to the present invention.

Many components of the apparatus used to make a fibrous structure 20 according to the present invention are well known in the art of papermaking. As illustrated in FIG. 2, the apparatus may comprise a means 44 for depositing a liquid carrier and cellulosic fibers entrained therein onto a liquid pervious fiber retentive forming element Referring to FIG. 3, the liquid pervious fiber retentive forming element may be a forming belt 42, is the heart of the apparatus and represents one component of the apparatus which departs from the prior art to manufacture the cellulosic fibrous structures 20 described and claimed herein. Particularly, the liquid pervious fiber retentive forming element has protuberances 59 which form the low and intermediate basis weight regions 26 of the fibrous structure 20, and intermediate annuluses 65 which form the high basis weight regions 24 of the cellulosic fibrous structure 20.

Referring back to FIG. 2, the apparatus may further comprise a secondary belt 46 to which the fibrous structure 20 is transferred after the majority of the liquid carrier is drained away and the cellulosic fibers are retained on the forming belt 42. The secondary belt 46 may further comprise a pattern of knuckles or projections not coincident the regions 24, 26, and 28 of the cellulosic fibrous structure 20. The forming and secondary belts 42 and 46 travel in the directions depicted by arrows A and B respectively.

After deposition of the liquid carrier and entrained cellulosic fibers onto the forming belt 42, the fibrous structure 20 is dried according to either or both of known drying means 50*a* and 50*b*, such as a blow through dryer 50*a*, and/or a Yankee drying drum 50*b*. Also, the apparatus may comprise a means, such as a doctor blade 68, for foreshortening or creping the fibrous structure 20.

Figure 3:
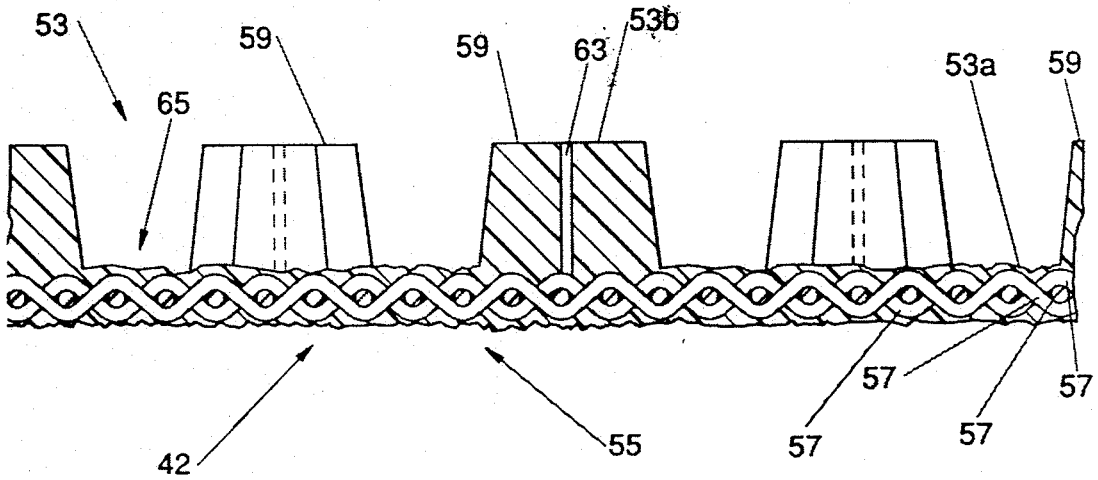
FIG. 3 is a fragmentary side elevational view of a forming element taken along line 3—3 of FIG. 2.

If a forming belt 42 is selected for the forming element of the apparatus used to make the cellulosic fibrous structure 20, the forming belt 42 has two mutually opposed faces, a first face 53 and a second face 55, as illustrated in FIG. 3. The first face 53 is the surface of the forming belt 42 which contacts the fibers of the cellulosic structure 20 being formed. The first face 53 has been referred to in the art as the paper contacting side of the forming belt 42. The first face 53 has two topographically distinct regions 53*a* and 53*b*. The regions 53*a* and 53*b* are distinguished by the amount of orthogonal variation from the second and opposite face 55 of the forming belt 42. Such orthogonal variation is considered to be in the Z-direction. As used herein the "Z-direction" refers to the direction away from and generally orthogonal to the XY plane of the forming belt 42, considering the forming belt 42 to be a planar, two-dimensional structure.

The forming belt 42 should be able to withstand all of the known stresses and operating conditions in which cellulosic, two-dimensional structures are processed and manufactured. A particularly preferred forming belt 42 may be made according to the teachings of U.S. Pat. No. 4,514,345 issued Apr. 30, 1985 to Johnson et al., and particularly according to FIG. 5 of Johnson et al., which patent is incorporated herein by reference for the purpose of showing a particularly suitable forming element for use with the present invention and a method of making such forming element.

The forming belt 42 is liquid pervious in at least one direction, particularly the direction from the first face 53 of the belt, through the forming belt 42, to the second face 55 of the forming belt 42. As used herein "liquid pervious" refers to the condition where the liquid carrier of a fibrous slurry may be transmitted through the forming belt 42 without significant obstruction. It may, of course, be helpful or even necessary to apply a slight differential pressure to assist in transmission of the liquid through the forming belt 42 to insure that the forming belt 42 has the proper degree of perviousness.

It is not, however, necessary, or even desired, that the entire surface area of the forming belt 42 be liquid pervious. It is only necessary that the liquid carrier of the fibrous slurry be easily removed from the slurry leaving on the first face 53 of the forming belt 42 an embryonic fibrous structure 20 of the deposited fibers.

The forming belt 42 is also fiber retentive. As used herein a component is considered "fiber retentive" if such component retains a majority of the fibers deposited thereon in a macroscopically predetermined pattern or geometry, without regard to the orientation or disposition of any particular fiber. Of course, it is not expected that a fiber retentive component will retain one hundred percent of the fibers deposited thereon (particularly as the liquid carrier of the fibers drains away from such component) nor that such retention be permanent. It is only necessary that the fibers be retained on the forming belt 42, or other fiber retentive component, for a period of time sufficient to allow the steps of the process to be satisfactorily completed.

Referring to FIG. 3, the forming belt 42 may be thought of as having a reinforcing structure 57 and a patterned array of protuberances 59 joined in face to face relation to the reinforcing structure 57, to define the two mutually opposed faces 53 and 55. The reinforcing structure 57 may comprise a foraminous element, such as a woven screen or other apertured framework. The reinforcing structure 57 is substantially liquid pervious. A suitable foraminous reinforcing structure 57 is a screen having a mesh size of about 6 to about 50 filaments per centimeter (15.2 to 127 filaments per inch) as seen in the plan view, although it is to be recognized that warp filaments are often stacked, doubling the filament count specified above. The openings between the filaments may be generally square, as illustrated, or of any other desired cross-section. The filaments may be formed of polyester strands, woven or nonwoven fabrics. Particularly, a 52 dual mesh reinforcing structure 57 has been found to work well.

One face 55 of the reinforcing structure 57 may be essentially macroscopically monoplanar and comprises the outwardly oriented face 53 of the forming belt 42. The inwardly oriented face of the forming belt 42 is often referred to as the backside of the forming belt 42 and, as noted above, contacts at least part of the balance of the apparatus employed in a papermaking operation. The opposing and outwardly oriented face 53 of the reinforcing structure 57 may be referred to as the fiber-contacting side of the forming belt 42, because the fibrous slurry, discussed above, is deposited onto this face 53 of the forming belt 42.

The patterned array of protuberances 59 is joined to the reinforcing structure 57 and preferably comprises individual protuberances 59 joined to and extending outwardly from the inwardly oriented face 53 of the reinforcing structure 57 as illustrated in FIG. 3. The protuberances 59 are also considered to be fiber contacting, because the patterned array of protuberances 59 receives, and indeed may be covered by, the fibrous slurry as it is deposited onto the forming belt 42.

The protuberances 59 may be joined to the reinforcing structure 57 in any known manner, with a particularly preferred manner being joining a plurality of the protuberances 59 to the reinforcing structure 57 as a batch process incorporating a hardenable polymeric photosensitive resin—rather than individually joining each protuberance 59 of the patterned array of protuberances 59 to the reinforcing structure 57. The patterned array of protuberances 59 is preferably formed by manipulating a mass of generally liquid material so that, when solidified, such material is contiguous with and forms part of the protuberances 59 and at least partially surrounds the reinforcing structure 57 in contacting relationship, as illustrated in FIG. 3.

Figure 4:
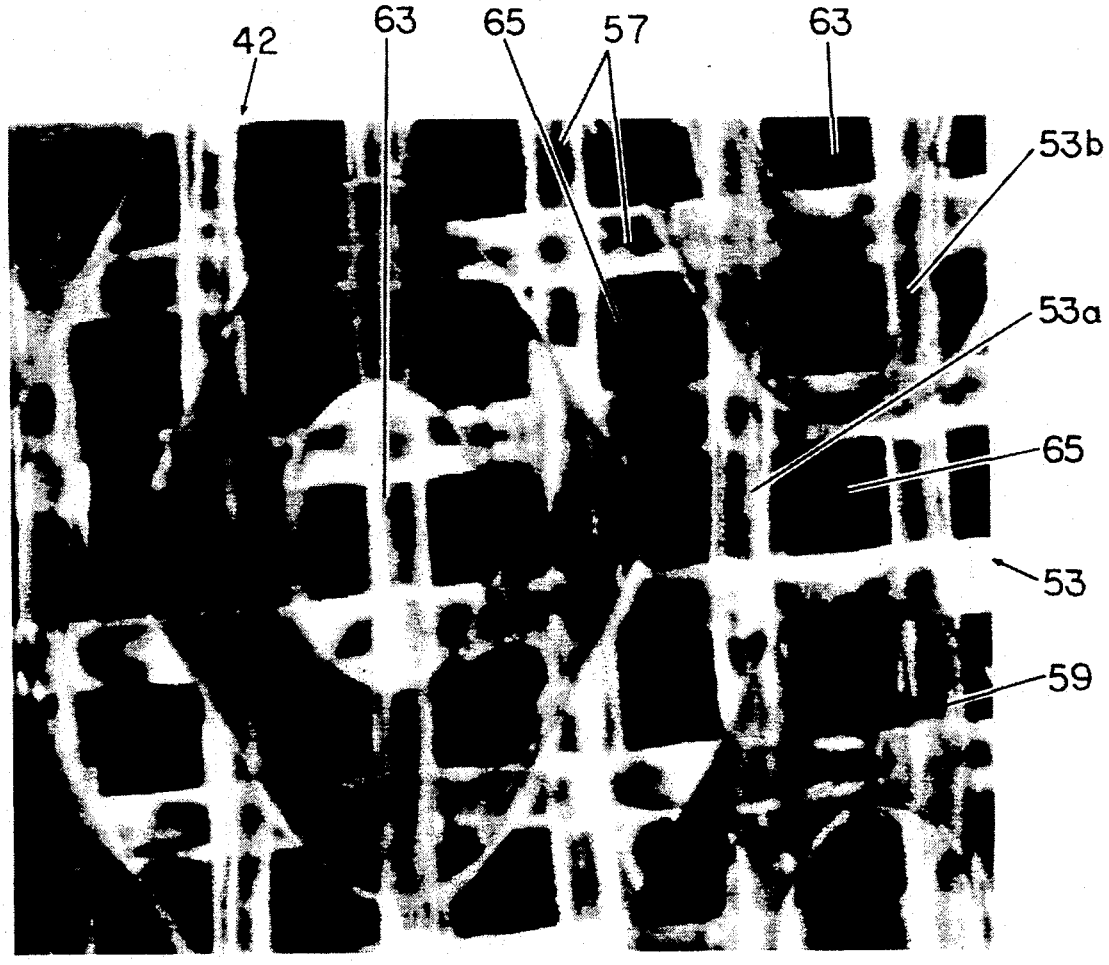
FIG. 4 is a fragmentary top plan view of the forming element of FIG. 3, taken along line 4—4 of FIG. 3 and having an orifice through each protuberance.

As illustrated in FIG. 4, the patterned array of protuberances 59 should be arranged so that a plurality of conduits, into which fibers of the fibrous slurry may deflect, extend in the Z-direction from the free ends 53*b* of the protuberances 59 to the proximal elevation 53*a* of the outwardly oriented face 53 of the reinforcing structure 57. This arrangement provides a defined topography to the forming belt 42 and allows for the liquid carrier and fibers therein to flow to the reinforcing structure 57. The conduits between adjacent protuberances 59 have a defined flow resistance which is dependent upon the pattern, size and spacing of the protuberances 59.

The protuberances 59 are discrete and preferably regularly spaced so that large scale weak spots in the essentially continuous network 24 of the fibrous structure 20 are not formed. The liquid carrier may drain the through annuluses 65 between adjacent protuberances 59 to the reinforcing structure 57 and deposit fibers thereon. More preferably, the protuberances 59 are distributed in a nonrandom repeating pattern so that the essentially continuous network 24 of the fibrous structure 20 (which is formed around and between the protuberances 59) more uniformly distributes applied tensile loading throughout the fibrous structure 20. Most preferably, the protuberances 59 are bilaterally staggered in an array, so that adjacent low basis weight regions 28 in the resulting fibrous structure 20 are not aligned with either principal direction to which tensile loading may be applied.

Referring back to FIG. 3, the protuberances 59 are upstanding and joined at their proximal ends 53*a* to the outwardly oriented face 53 of the reinforcing structure 57 and extend away from this face 53 to a distal or free end 53*b* which defines the furthest orthogonal variation of the patterned array of protuberances 59 from the outwardly oriented face 53 of the reinforcing structure 57. Thus, the outwardly oriented face 53 of the forming belt 42 is defined at two elevations. The proximal elevation of the outwardly oriented face 53 is defined by the surface of the reinforcing structure 57 to which the proximal ends 53*a* of the protuberances 59 are joined, taking into account, of course, any material of the protuberances 59 which surrounds the reinforcing structure 57 upon solidification. The distal elevation of the outwardly oriented face 53 is defined by the free ends 53*b* of the patterned array of protuberances 59. The opposed and inwardly oriented face 55 of the forming belt 42 is defined by the other face of the reinforcing structure 57, taking into account, of course, any material of the protuberances 59 which surrounds the reinforcing structure 57 upon solidification, which face is opposite the direction of extent of the protuberances 59.

The protuberances 59 may extend, orthogonal the plane of the forming belt 42, outwardly from the proximal elevation of the outwardly oriented face 53 of the reinforcing structure 57 about 0 millimeters to about 1.3 millimeters (0 to 0.050 inches). Obviously, if the protuberances 59 have zero extent in the Z-direction, a more nearly constant basis weight cellulosic fibrous structure 20 is approximated. Therefore, if it is desired to minimize the difference in basis weights between adjacent high basis weight regions 24 and low basis weight regions 28 of the cellulosic fibrous structure 20, generally shorter protuberances 59 should be utilized.

As illustrated in FIG. 4, the protuberances 59 preferably do not have sharp corners, particularly in the XY plane, so that stress concentrations in the resulting high basis weight regions 24 of the cellulosic fibrous structure 20 of FIG. 1 are obviated. A particularly preferred protuberance 59 is curvirhombohedrally shaped, having a cross-section which resembles a rhombus with radiused corners.

Without regard to the cross-sectional area of the protuberances 59, the sides of the protuberances 59 may be generally mutually parallel and orthogonal the plane of the forming belt 42. Alternatively, the protuberances 59 may be somewhat tapered, yielding a frustroconical shape, as illustrated in FIG. 3.

It is not necessary that the protuberances 59 be of uniform height or that the free ends 53*b* of the protuberances 59 be equally spaced from the proximal elevation 53*a* of the outwardly oriented face 53 of the reinforcing structure 57. If it is desired to incorporate more complex patterns than those illustrated into the fibrous structure 20, it will be understood by one skilled in the art that this may be accomplished by having a topography defined by several Z-directional levels of upstanding protuberances 59—each level yielding a different basis weight than occurs in the regions of the fibrous structure 20 defined by the protuberances 59 of the other levels. Alternatively, this may be otherwise accomplished by a forming belt 42 having an outwardly oriented face 53 defined by more than two elevations by some other means, for example, having uniform sized protuberances 59 joined to a reinforcing structure 57 having a planarity which significantly varies relative to the Z-direction extent of the protuberances 59.

As illustrated in FIG. 4, the patterned array of protuberances 59 may, preferably, range in area, as a percentage of the projected surface area of the forming belt 42, from a minimum of about 20 percent of the total projected surface area of the forming belt 42 to a maximum of about 80 percent of the total projected surface area of the forming belt 42, with the reinforcing structure 57 providing the balance of the projected surface area of the forming belt 42. The contribution of the patterned array of protuberances 59 to the total projected surface area of the forming belt 42 is taken as the aggregate of the projected area of each protuberance 59 taken at the maximum projection against an orthogonal to the outwardly oriented face 53 of the reinforcing structure 57.

It is to be recognized that as the contribution of the protuberances 59 to the total surface area of the forming belt 42 diminishes, the previously described high basis weight essentially continuous network 24 of the fibrous structure 20 increases, minimizing the economic use of raw materials. Further, the surface area between adjacent protuberances 59 of the proximal elevation 53*a* of the forming belt 42 should be increased as the length of the fibers increases, otherwise the fibers may not cover the protuberances 59 and not penetrate the conduits between adjacent protuberances 59 to the reinforcing structure 57 defined by the surface area of the proximal elevation 53*a*.

The second face 55 of the forming belt 42 may have a defined and noticeable topography or may be essentially macroscopically monoplanar. As used herein "essentially macroscopically monoplanar" refers to the geometry of the forming belt 42 when it is placed in a two-dimensional configuration and has only minor and tolerable deviations from absolute planarity, which deviations do not adversely affect the performance of the forming belt 42 in producing cellulosic fibrous structures 20 as described above and claimed below. Either geometry of the second face 55, topographical or essentially macroscopically monoplanar, is acceptable, so long as the topography of the first face 53 of the forming belt 42 is not interrupted by deviations of larger magnitude, and the forming belt 42 can be used with the process steps described herein. The second face 55 of the forming belt 42 may contact the equipment used in the process of making the fibrous structure 20 and has been referred to in the art as the machine side of the forming belt 42.

The protuberances 59 define annuluses 65 having multiple and mutually different flow resistances in the liquid pervious portion of the forming belt 42. One manner in which differing regions may be provided is illustrated in FIG. 4. Each protuberance 59 of the forming belt of FIG. 4 is substantially equally spaced from the adjacent protuberance 59, providing an essentially continuous network annulus 65 between adjacent protuberances 59.

Extending in the Z-direction through the approximate center of a plurality of the protuberances 59 or, through each of the protuberances 59, is an orifice 63 which provides liquid communication between the free end **53*b* of the protuberance 59 and the proximal elevation 53*a* of the outwardly oriented face 53 of the reinforcing structure 57**.

The flow resistance of the orifice 63 through the protuberance 59 is different from, and typically greater than, the flow resistance of the annulus 65 between adjacent protuberances 59. Therefore, typically more of the liquid carrier will drain through the annuluses 65 between adjacent protuberances 59 than through the aperture within and circumscribed by the free end **53*b* of a particular protuberance 59. Because less liquid carrier drains through the orifice 63, than through the annulus 65 between adjacent protuberances 59, relatively more fibers are deposited onto the reinforcing structure 57 subjacent the annulus 65 between adjacent protuberances 59 than onto the reinforcing structure 57 subjacent the apertures 63**.

The annuluses 65 and apertures 63 respectively define high flow rate and and low flow rate zones in the forming belt 42. Because the flow rate through the annuluses 65 is greater than the flow rate through the apertures 63 (due to the greater flow resistance of the apertures 63) the initial mass flow rate of the liquid carrier will be greater through the annuluses 65 will be greater than the initial mass flow rate through the apertures 63.

It will be recognized that no liquid carrier will flow through the protuberances 59, because the protuberances 59 are impervious to the liquid carrier. However, depending upon the elevation of the distal ends **53*b* of the protuberances 59 and the length of the cellulosic fibers, cellulosic fibers may be deposited on the distal ends 53*b* of the protuberances 59**.

As used herein, the "initial mass flow rate" refers to the flow rate of the liquid carrier when it is first introduced to and deposited upon the forming belt 42. Of course it will be recognized that both flow rate zones will decrease in mass flow rate as a function of time as the apertures 63 or annuluses 65 which define the zones become obturated with cellulosic fibers suspended in the liquid carrier and retained by the forming belt 42. The difference in flow resistance between the apertures 63 and the annuluses 65 provide a means for retaining different basis weights of cellulosic fibers in a pattern in the different zones of the forming belt 42.

This difference in flow rate through the zones is referred to as "staged draining," in recognition that a step discontinuity exists between the initial flow rate of the liquid carrier through the high and low flow rate zones. Staged draining can be advantageously used, as described above, to deposit different amounts of fibers in a tessellating pattern in the cellulosic fibrous structure 20.

More particularly, the high basis weight regions 24 will occur in a nonrandom repeating pattern substantially corresponding to the high flow rate zones (the annuluses 65) of the forming belt 42 and to the high flow rate stage of the process used to manufacture the cellulosic fibrous structure 20. The intermediate basis weight regions 26 will occur in a nonrandom repeating pattern substantially corresponding to the low flow rate zones (the apertures 63) of the forming belt 42 and to the low flow rate stage of the process used to manufacture the cellulosic fibrous structure 20. The low basis weight regions 28 will occur in a nonrandom repeating pattern corresponding to the protuberances 59 of the forming belt 42 and to neither the high flow rate stage nor to the low flow rate stage of the process used to manufacture the cellulosic fibrous structure 20.

The flow resistance of the entire forming belt 42 can be easily measured according to techniques well-known to one skilled in the art. However, measuring the flow resistance of the high and low flow rate zones, and the differences in flow resistance therebetween is more difficult due to the small size of the high and low flow rate zones. However, flow resistance may be inferred from the hydraulic radius of the zone under consideration. Generally flow resistance is inversely proportional to the hydraulic radius.

The hydraulic radius of a zone is defined as the area of the zone divided by the wetted perimeter of the zone. The denominator frequently includes a constant, such as 4. However, since, for this purpose, it is only important to examine differences between the hydraulic radii of the zones, the constant may either be included or omitted as desired. Algebraically this may be expressed as:

$$\text{Hydraulic Radius} = \frac{\text{Flow Area}}{k \times \text{Wetted Perimeter}}$$

wherein the flow area is the area through the orifice 63 of the protuberance 59, or the flow area between unit cells, i.e. the smallest repeating pattern of annuluses formed by adjacent protuberances 59, as more fully defined below and the wetted perimeter is the linear dimension of the perimeter of the zone in contact with the liquid carrier. The flow area does not take into consideration any restrictions imposed by the reinforcing structure 57 underneath the protuberances 59. The hydraulic radii of several common shapes are well-known and can be found in many references such as Mark's Standard Handbook for Mechanical Engineers, eighth edition, which reference is incorporated herein by reference for the purpose of showing the hydraulic radius of several common shapes and a teaching of how to find the hydraulic radius of irregular shapes.

For the forming belts, illustrated in FIG. 4, the two zones of interest are defined as follows. The high flow rate zones comprise the annular perimeter circumscribing a protuberance 59. The extent of the annular perimeter in the XY direction for a given protuberance 59 is one-half of the radial distance from the protuberance 59 to the adjacent protuberance 59. Thus, the region 69 between adjacent protuberances 59 will have a border, centered therein, which is coterminous the annular perimeter of the adjacent protuberances 59 defining such annulus 65 between the adjacent protuberances 59.

Furthermore, because the protuberances 59 extend in the Z-direction to an elevation above that of the balance of the reinforcing structure 57, fewer fibers will be deposited in the regions superjacent the protuberances 59, because the fibers deposited on the portions of the reinforcing structure 57 corresponding to the apertures 63 and annuluses 65 between adjacent protuberances must build up to the elevation of the free ends **53*b* of the protuberances 59, before additional fibers will remain on top of the protuberances 59 without being drained into either the orifice 63 or annulus 65 between adjacent protuberances 59**.

One nonlimiting example of a forming belt 42 which has been found to work well in accordance with the present invention has a 52 dual mesh weave reinforcing structure 57. The reinforcing structure 57 is made of filaments having a warp diameter of about 0.15 millimeters (0.006 inches) a shute diameter of about 0.18 millimeters (0.007 inches) with about 45–50 percent open area. The reinforcing structure 57 can pass approximately 36,300 standard liters per minute (1,280 standard cubic feet per minute) air flow at a differential pressure of about 12.7 millimeters (0.5 inches) of water. The thickness of the reinforcing structure 57 is about 0.76 millimeters (0.03 inches), taking into account the knuckles formed by the woven pattern between the two faces 53 and 55 of the forming belt 42.

Joined to the reinforcing structure 57 of the forming belt 42 is a plurality of bilaterally staggered protuberances 59. Each protuberance 59 is spaced from the adjacent protuberance on a machine direction pitch of about 19.9 millimeters (0.785 inches) and a cross machine direction pitch of about 10.8 millimeters (0.425 inches). The protuberances 59 are provided at a density of about 47 protuberances 59 per square centimeter (300 protuberances 59 per square inch).

Each protuberance 59 has a width in the cross machine direction between opposing corners of about 9.1 millimeters (0.357 inches) and a length in the machine direction between opposing corners of about 13.6 millimeters (0.537 inches). The protuberances 59 extend in about 0.8 millimeters (0.003 inches) in the Z-direction from the proximal elevation **53*a* of the outwardly oriented face 53 of the reinforcing structure 57 to the free end 53*b* of the protuberance 59**.

Each protuberance 59 has an orifice 63 centered therein and extending from the free end **53*b* of the protuberance to the proximal elevation 53*a* of the protuberance so that the free end 53*b* of the protuberance is in liquid communication with the reinforcing structure 57. Each orifice 63 centered in the protuberance 59 is generally elliptically shaped and has a major axis of about 5.9 millimeters (0.239 inches) and a minor axis of about 4.1 millimeters (0.160 inches). The orifice 63 comprises about 29 percent of the surface area of the protuberance 59. With the protuberances 59 adjoined to the reinforcing structure 57, the forming belt 42** has an air permeability of about 490 standard liters per minute (13,900 standard cubic feet per minute) and air flow at a differential pressure at about 12.7 millimeters (0.5 inches) of water.

The aforementioned forming belt 42 produces the fibrous structure 20 illustrated in FIG. 1. It is to be recognized however the foregoing example is nonlimiting and many variations in the reinforcing structure, protuberances 59, apertures 63 therethrough, and/or annuluses 65 between adjacent protuberances 59 are feasible and within the scope of the claimed invention.

As illustrated in FIG. 2, the apparatus further comprises a means 44 for depositing the liquid carrier and entrained cellulosic fibers onto its forming belt 42, and more particularly onto the face 53 of the forming belt 42 having the discrete upstanding protuberances 59, so that the reinforcing structure 57 and the protuberances 59 are completely covered by the fibrous slurry. A headbox 44, as is well known in the art, may be advantageously used for this purpose. While several types of headboxes 44 are known in the art, one headbox 44 which has been found to work well is a conventional Fourdrinier headbox 44 which generally continuously applies and deposits the fibrous slurry onto the outwardly oriented face 53 of the forming belt 42.

The means 44 for depositing the fibrous slurry and the forming belt 42 are moved relative to one another, so that a generally consistent quantity of the liquid carrier and entrained cellulosic fibers may be deposited on the forming belt 42 in a continuous process. Alternatively, the liquid carrier and entrained cellulosic fibers may be deposited on the forming belt 42 in a batch process. Preferably, the means 44 for depositing the fibrous slurry onto the pervious forming belt 42 can be regulated, so that as the rate of differential movement between the forming belt 42 and the depositing means 44 increases or decreases, larger or smaller quantities of the liquid carrier and entrained cellulosic fibers may be deposited onto the forming belt 42 per unit of time, respectively.

Also, a means **50*a* and/or 50*b* for drying the fibrous slurry from the embryonic fibrous structure 20 of fibers to form a two-dimensional fibrous structure 20 having a consistency of at least about 90 percent may be provided. Any convenient drying means 50*a* and/or 50*b* well known in the papermaking art can be used to dry the embryonic fibrous structure 20 of the fibrous slurry. For example, press felts, thermal hoods, infra-red radiation, blow-through dryers 50*a*, and Yankee drying drums 50*b*, each used alone or in combination, are satisfactory and well known in the art. A particularly preferred drying method utilizes a blow-through dryer 50*a*, and a Yankee drying drum 50*b*** in sequence.

If desired, an apparatus according to the present invention may further comprise an emulsion roll 66, as shown in FIG. 2. The emulsion roll 66 distributes an effective amount of a chemical compound to either forming belt 42 or, if desired, to the secondary belt 46 during the process described above. The chemical compound may act as a release agent to prevent undesired adhesion of the fibrous structure 20 to either forming belt 42 or to the secondary belt 46. Further, the emulsion roll 66 may be used to deposit a chemical compound to treat the forming belt 42 or secondary belt 46 and thereby extend its useful life. Preferably, the emulsion is added to the outwardly oriented topographical faces 53 of the forming belt 42 when such forming belt 42 does not have the fibrous structure 20 in contact therewith. Typically, this will occur after the fibrous structure 20 has been transferred from the forming belt 42, and the forming belt 42 is on the return path.

Preferred chemical compounds for emulsions include compositions containing water, high speed turbine oil known as Regal Oil sold by the Texaco Oil Company of Houston, Tex. under product number R&0 68 Code 702; dimethyl distearyl ammioniumchloride sold by the Sherex Chemical Company, Inc. of Rolling Meadows, Ill. as AOGEN TA100; cetyl alcohol manufactured by the Procter & Gamble Company of Cincinnati, Ohio; and an antioxidant such as is sold by American Cyanamid of Wayne, N.J. as Cyanox 1790. Also, if desired, cleaning showers or sprays (not shown) may be utilized to cleanse the forming belt 42 of fibers and other residues remaining after the fibrous structure 20 is transferred from the forming belt 42.

An optional, but highly preferred step in providing a cellulosic fibrous structure 20 according to the present invention is foreshortening the fibrous structure 20 after it is dried. As used herein, "foreshortening" refers to the step of reducing the length of the fibrous structure 20 by rearranging the fibers and disrupting fiber to fiber bonds. Foreshortening may be accomplished in any of several well known ways, the most common and preferred being creping.

The step of creping may be accomplished in conjunction with the step of drying, by utilizing the aforementioned Yankee drying drum 50*b*. In the creping operation, the cellulosic fibrous structure 20 is adhered to a surface, preferably the Yankee drying drum 50*b* and then removed from that surface with a doctor blade 68 by the relative movement between the doctor blade 68 and the surface to which the fibrous structure 20 is adhered. The doctor blade 68 is oriented with a component orthogonal the direction of relative movement between the surface and the doctor blade 68, and is preferably substantially orthogonal thereto.

Also, a means for applying a differential pressure to selected portions of the fibrous structure 20 may be provided. The differential pressure may cause densification or dedensification of the regions 24, 26 and 28. The differential pressure may be applied to the fibrous structure 20 during any step in the process before too much of the liquid carrier is drained away, and is preferably applied while the fibrous structure 20 is still an embryonic fibrous structure 20. If too much of the liquid carrier is drained away before the differential pressure is applied, the fibers may be too stiff and not sufficiently conform to the topography of the patterned array of protuberances 59, thus yielding a fibrous structure 20 that does not have the described regions of differing density.

If desired, the number of regions 24, 26 and 28 of the fibrous structure 20 may be further subdivided according to density, by utilizing the means for applying a differential pressure to selected portions of the fibrous structure 20. That is to say each region 24, 26 or 28 of a particular basis weight may be manipulated by the apparatus and process herein described so that each such region 24, 26 or 28 of a particular basis weight will have more than one density.

For example, if it is desired to increase the fiber to fiber bonding, and thus enhance the tensile strength of the fibrous structure 20, it is feasible to increase the density of selected sites of the essentially continuous network high basis weight region 24. This may be done by transferring the cellulosic fibrous structure 20 from the forming belt 42 to a secondary belt 46 having projections which are not coincident the discrete protuberances 59 of the forming belt 42. During (or after) the transfer the projections of the secondary belt 46 compress selected sites of regions 24, 26, and 28 of the cellulosic fibrous structure 20 causing densification of such sites to occur.

Of course, a greater degree of densification will be imparted to the sites in the high basis weight regions 24, than to the sites of the intermediate basis weight regions 26 or the low basis weight regions 28 due to the greater number of fibers present in the high basis weight regions 24. Thus, by selectively incorporating the proper degree of densification to the cellulosic fibrous structure 20, one may impart densification only to the selected sites in the high basis weight regions, impart densification to the selected sites in the high and intermediate basis weight regions or, impart densification to the selected sites in the high, intermediate and low basis weight regions 24, 26, and 28.

Therefore, by using selective densification, it is possible to make a structure having four regions: a high basis weight region 24 having a particular density, a high basis weight region 24 having a relatively greater density than the balance of the high basis weight region 24, an intermediate basis weight region 26, and a low basis weight region 28. Alternatively, it is possible to make a fibrous structure 20 having five regions: a high basis weight region 24 of a first density, and a high basis weight region 24 having a relatively greater density, an intermediate basis weight region 26 having a first density, an intermediate basis weight region 26 having a relatively greater density, and a low basis weight region 28. Finally, of course, it is possible to make a cellulosic fibrous structure 20 having six regions: a high basis weight region 24 having a first density, a high basis weight region 24 having a first density, a high basis weight region 24 having a relatively greater density, an intermediate basis weight region 26 having a first density, an intermediate basis weight region 26 having a relatively greater density, a low basis weight region 28 having a first density, and a low basis weight region 28 having a relatively greater density.

When selected sites are compressed by the projections of the secondary belt 46, such sites are densified and incur greater fiber to fiber bonding. Such densification increases the tensile strength of such sites and increases the tensile strength of the entire cellulosic fibrous structure 20.

Alternatively, the selected sites of the various regions 24, 26 or 28 may be dedensified, increasing the caliper and absorbency of such sites. Dedensification may occur by transferring the cellulosic fibrous structure 20 from the forming belt 42 to a secondary belt 46 having vacuum pervious regions 63 not coincident with the protuberances 59 or the various regions 24, 26 and 28 of the cellulosic fibrous structure 20. After transfer of the cellulosic fibrous structure to the secondary belt 46, a differential fluid pressure, either positive or subatmospheric, is applied to the vacuum pervious regions 63 of the secondary belt 46. The differential fluid pressure causes deflection of the fibers of each site which is coincident the vacuum pervious regions 63 in a plain normal to the secondary belt 46. By deflecting the fibers of the sites subjected to the differential fluid pressure, the fibers move away from the plane of the cellulosic fibrous structure 20 and increase the caliper thereof.

A preferred apparatus to apply a differential fluid pressure to the sites of the cellulosic fibrous structure 20 coincident the vacuum pervious regions 63 of the secondary belt 46 is a vacuum box 47 which applies a subatmospheric differential fluid pressure to the face of the secondary belt 46 which is not in contact with the cellulosic fibrous structure 20.

The Process

The cellulosic fibrous structure 20 according to the present invention may be made according to the process comprising the steps of providing a plurality of cellulosic fibers entrained in a liquid carrier. The cellulosic fibers are not dissolved in the liquid carrier, but merely suspended therein. Also provided is a liquid pervious fiber retentive forming element, such as a forming belt 42 and a means 44 for depositing the liquid carrier and entrained cellulosic fibers onto the forming belt 42.

The forming belt 42 has high flow rate and low flow rate liquid pervious zones respectively defined by annuluses 65 and apertures 63. The forming belt also has upstanding protuberances 59.

The liquid carrier and entrained cellulosic fibers are deposited onto the forming belt 42 as illustrated in FIG. 2. The liquid carrier is drained through the forming belt 42 in two simultaneous stages, a high flow rate stage and a low flow rate stage. In the high flow rate stage, the liquid carrier drains through the liquid pervious high flow rate zones at a given initial flow rate until obturation occurs (or the liquid carrier is no longer introduced to this portion of the forming belt 42).

In the low flow rate stage, the liquid carrier drains through low flow rate zones of the forming belt at a given initial flow rate which is less than the initial flow rate through the high flow rate zones.

Of course the flow rate through both the high and low flow rate zones in the forming belt 42 decreases as a function of time, due to expected obturation of both zones. Without being bound by any theory, the low flow rate zones may selectively obturate before the high flow rate zones obturate.

The first occurring zone obturation may be due to the lesser hydraulic radius and greater flow resistance of such zones, based upon factors such as the flow area, wetted perimeter, shape and distribution of the low flow rate zones. The low flow rate zones may, for example, comprise apertures 63 through the protuberances 59, which apertures 63 have a greater flow resistance than the liquid pervious annuluses 65 between adjacent protuberances 59.

Analytical Procedures

Opacity

To quantify relative differences in opacity, a Nikon stereomicroscope, model SMZ-2T sold by the Nikon Company, of New York, N.Y. may be used in conjunction with a C-mounted Dage MTI model NC-70 video camera. The image from the microscope may be stereoscopically viewed through the oculars or viewed in two dimensions on a computer monitor. The analog image data from the camera attached to the microscope may be digitized by a video card made by Data Translation of Marlboro, Mass. and analyzed on a MacIntosh IIx computer made by the Apple Computer Co. of Cupertino, Calif. Suitable software for the digitization and analysis is IMAGE, version 1.31, available from the National Institute of Health, in Washington, D.C.

The sample is viewed through the oculars, using stereoscopic capabilities of the microscope to determine areas of the sample wherein the fibers are substantially within the plane of the sample and other areas of the sample which have fibers deflected normal to the plane of the sample. It may be expected that the areas having fibers deflected normal to the plane of the sample will be of lower density than the areas having fibers which lie principally within the plane of the sample. Two areas, one representative of each of the aforementioned fiber distributions, should be selected for further analysis.

For the user's convenience in identifying the areas of the sample of interest, a hand held opaque mask, having a transparent window slightly larger than the area to be analyzed, may be used. The sample is disposed with an area of interest centered on the microscope stage. The mask is placed over the sample so that the transparent window is centered and captures the area to be analyzed. This area and the window are then centered on the monitor. The mask should be removed so that any translucent qualities of the window do not offset the analysis.

While the sample is on the microscope stage, the backlighting is adjusted so that relatively fine fibers become visible. The threshold gray levels are determined and set to coincide with the smaller sized capillaries. A total of 256 gray levels, as described above, has been found to work well, with 0 representing a totally white appearance, and 255 representing a totally black appearance. For the samples described herein, threshold gray levels of approximately 0 to 125 have been found to work well in the detection of the capillaries.

The entire selected area is now bicolored, having a first color represent the detected capillaries as discrete particles and the presence of undetected fibers represented by gray level shading. This entire selected area is cut and pasted from the surrounding portion of the sample, using either the mouse or the perfect square pattern found in the software. The number of thresholded gray level particles, representing the projection of capillaries which penetrate through the thickness of the sample, and the average of their sizes (in units of area) may be easily tabulated using the software. The units of the particle size will either be in pixels or, if desired, may be micrometer calibrated to determine the actual surface area of the individual capillaries.

This procedure is repeated for the second area of interest. The second area is centered on the monitor, then cut and pasted from the balance of the sample, using the hand-held mask as desired. Again, the thresholded particles, representing the projection of capillaries which penetrate through the thickness of the sample, are counted and the average of their sizes tabulated.

Any difference in the opacity between the regions 24, 26 and 28 under consideration is now quantified. As disclosed above, it is expected that the regions 24 of high basis weight regions 24 will have greater opacity than the intermediate basis weight regions 26 which will have greater opacity than the low basis weight regions 28.

Basis Weight

The basis weight of a cellulosic fibrous structure 20 according to the present invention may be qualitatively measured by optically viewing (under magnification if desired) the fibrous structure 20 in a direction generally normal to the plane of the fibrous structure 20. If differences in the amount of fibers, particularly the amount observed from any line normal to the plane, occur in a nonrandom, regular repeating pattern, it can generally be determined that basis weight differences occur in a like fashion.

Particularly the judgment as to the amount of fibers stacked on top of other fibers is relevant in determining the basis weight of any particular region 24, 26 or 28 or differences in basis weights between any two regions 24, 26 or 28. Generally, differences in basis weights among the various regions 24, 26 or 28 will be indicated by inversely proportional differences in the amount of light transmitted through such regions 24, 26 or 28.

If a more accurate determination of the basis weight of one region 24, 26 or 28 relative to a different region 24, 26, or 28, is desired, such magnitude of relative distinctions may be quantified using multiple exposure soft X-rays to make a radiographic image of the sample, and subsequent image analysis. Using the soft X-ray and image analysis techniques, a set of standards having known basis weights are compared to a sample of the fibrous structure 20. The analysis uses three masks: one to show the discrete low basis weight regions 28, one to show the continuous network of high basis weight regions 24, and one to show the transition regions. Reference will be made to memory channels in the following description. However, it is to be understood while these particular memory channels relate to a specific example, the following description of basis weight determination is not so limited.

In the comparison, the standards and the sample are simultaneously soft X-rayed in order to ascertain and calibrate the gray level image of the sample. The soft X-ray is taken of the sample and the intensity of the image is recorded on the film in proportion to the amount of mass, representative of the fibers in the fibrous structure 20, in the path of the X-rays.

If desired, the soft X-ray may be carried out using a Hewlett Packard Faxitron X-ray unit supplied by the Hewlett Packard Company, of Palo Alto, Calif. X-ray film sold as NDT 35 by the E. I. DuPont Nemours & Co. of Wilmington, Del. and JOBO film processor rotary tube units may be used to advantageously develop the image of the sample described hereinbelow.

Due to expected and ordinary variations between different X-ray units, the operator must set the optimum exposure conditions for each X-ray unit. As used herein, the Faxitron unit has an X-ray source size of about 0.5 millimeters, a 0.64 millimeters thick Beryllium window and a three milliamp continuous current. The film to source distance is about 61 centimeters and the voltage about 8 kVp. The only variable parameter is the exposure time, which is adjusted so that the digitized image would yield a maximum contrast when histogrammed as described below.

The sample is die cut to dimensions of about 2.5 by about 7.5 centimeters (1 by 3 inches). If desired, the sample may be marked with indicia to allow precise determination of the locations of regions 24, 26 and 28 having distinguishable basis weights. Suitable indicia may be incorporated into the sample by die cutting three holes out of the sample with a small punch. For the embodiments described herein, a punch about 1.0 millimeters (0.039 inches) in diameter has been found to work well. The holes may be colinear or arranged in a triangular pattern.

These indicia may be utilized, as described below, to match regions 24, 26 and 28 of a particular basis weight with regions 24, 26 and 28 distinguished by other intensive properties, such as thickness and/or density. After the indicia are placed on the sample, it is weighed on an analytical balance, accurate to four significant figures.

The DuPont NDT 35 film is placed onto the Faxitron X-ray unit, emulsion side facing upwards, and the cut sample is placed onto the film. About five 15 millimeter×15 millimeter calibration standards of known basis weights (which approximate and bound the basis weight of the various regions 24, 26, and 28 of the sample) and known areas are also placed onto the X-ray unit at the same time, so that an accurate basis weight to gray level calibration can be obtained each time the image of the sample is exposed and developed. Helium is introduced into the Faxitron for about 5 minutes at a regulator setting of about one psi, so that the air is purged and, consequently, absorption of X-rays by the air is minimized. The exposure time of the unit is set for about 2 minutes.

Following the helium purging of the sample chamber, the sample is exposed to the soft X-rays. When exposure is completed, the film is transferred to a safe box for developing under the standard conditions recommended by E. I. DuPont Nemours & Co., to form a completed radiographic image.

The preceding steps are repeated for exposure time periods of about 2.2, 2.5, 3.0, 3.5 and 4.0 minutes. The film image made by each exposure time is then digitized by using a high resolution radioscope Line Scanner, made by Vision Ten of Torrence, Calif., in the 8 bit mode. Images may be digitized at a spatial resolution of 1024×1024 discrete points representing 8.9×8.9 centimeters of the radiograph. Suitable software for this purpose includes Radiographic Imaging Transmission and Archive (RITA) made by Vision Ten. The images are then histogrammed to record the frequency of occurrence of each gray level value. The standard deviation is recorded for each exposure time.

The exposure time yielding the maximum standard deviation is used throughout the following steps. If the exposure times do not yield a maximum standard deviation, the range of exposure times should be expanded beyond that illustrated above. The standard deviations associated with the images of expanded exposure times should be recalculated. These steps are repeated until a clearly maximum standard deviation becomes apparent. The maximum standard deviation is utilized to maximize the contrast obtained by the scatter in the data. For the samples illustrated in FIGS. 8–14, an exposure time of about 2.5 to about 3.0 minutes was judged optimum.

The optimum radiograph is re-digitized in the 12 bit mode, using the high resolution Line Scanner to display the image on a 1024×1024 monitor at a one to one aspect ratio and the Radiographic Imaging Transmission and Archive software by Vision Ten to store, measure and display the images. The scanner lens is set to a field of view of about 8.9 centimeters per 1024 pixels. The film is now scanned in the 12 bit mode, averaging both linear and high to low lookup tables to convert the image back to the eight bit mode.

This image is displayed on the 1024×1024 line monitor. The gray level values are examined to determine any gradients across the exposed areas of the radiograph not blocked by the sample or the calibration standards. The radiograph is judged to be acceptable if any one of the following three criteria is met:

the film background contains no gradients in gray level values from side to side;

the film background contains no gradients in gray level values from top to bottom; or a gradient is present in only one direction, i.e. a difference in gray values from one side to the other side at the top of the radiograph is matched by the same difference in gradient at the bottom of the radiograph.

One possible shortcut method to determine whether or not the third condition may be met is to examine the gray level values of the pixels located at the four corners of the radiograph, which covers are adjacent the sample image.

The remaining steps may be performed on a Gould Model IP9545 Image Processor, made by Gould, Inc., of Fremont, Calif. and hosted by a Digitized Equipment Corporation VAX 8350 computer, using Library of Image Processor Software (LIPS) software.

A portion of the film background representative of the criteria set forth above is selected by utilizing an algorithm to select areas of the sample which are of interest. These areas are enlarged to a size of 1024×1024 pixels to simulate the film background. A gaussian filter (matrix size 29×29) is applied to smooth the resulting image. This image, defined as not containing either the sample or standards, is then saved as the film background.

This film background is digitally subtracted from the subimage containing the sample image on the film background to yield a new image. The algorithm for the digital subtraction dictates that gray level values between 0 and 128 should be set to a value of zero, and gray level values between 129 and 255 should be remapped from 1 to 127 (using the formula x-128). Remapping corrects for negative results that occur in the subtracted image. The values for the maximum, minimum, standard deviation, median, mean, and pixel area of each image area are recorded.

The new image, containing only the sample and the standards, is saved for future reference. The algorithm is then used to selectively set individually defined image areas for each of the image areas containing the sample standards. For each standard, the gray level histogram is measured. These individually defined areas are then histogrammed.

The histogram data from the preceding step is then utilized to develop a regression equation describing the mass to gray level relationship and which computes the coefficients for the mass per gray value equation. The independent variable is the mean gray level. The dependent variable is the mass per pixel in each calibration standard. Since a gray level value of zero is defined to have zero mass, the regression equation is forced to have a y intercept of zero. The equation may utilize any common spreadsheet program and be run on a common desktop personal computer.

The algorithm is then used to define the area of the image containing only the sample. This image, shown in memory channel 1, is saved for further reference, and is also classified as to the number of occurrences of each gray level. The regression equation is then used in conjunction with the classified image data to determine the total calculated mass. The form of the regression equation is:

$$Y=A\times X\times N$$

wherein Y equals the mass for each gray level bin; A equals the coefficient from the regression analysis; X equals the gray level (range 0–255); and N equals the number of pixels in each bin (determined from classified image). The summation of all of the Y values yields the total calculated mass. For precision, this value is then compared to the actual sample mass, determined by weighing.

The calibrated image of memory channel 1 is displayed onto the monitor and the algorithm is utilized to analyze a 256×256 pixel area of the image. This area is then magnified equally in each direction six times. All of the following images are formed from this resultant image.

If desired, an area of the resultant image, shown in memory channel 6, containing about ten nonrandom, repeating patterns of the various regions 24, 26, and 28 may be selected for segmentation of the various regions 24, 26 or 28. The resultant image shown in memory channel 6 is saved for future reference. Using a digitizing tablet equipped with a light pen, an interactive graphics masking routine may be used to define transition regions between the high basis weight regions 24 and the low basis weight regions 28. The operator should subjectively and manually circumscribe the discrete regions 26 with the light pen at the midpoint between the discrete regions 26 and the continuous regions 24 and 28 and fill in these regions 26. The operator should ensure a closed loop is formed about each circumscribed discrete region 26. This step creates a border around and between any discrete regions 26 which can be differentiated according to the gray level intensity variations.

The graphics mask generated in the preceding step is then copied through a bit plane to set all masked values (such as in region 26) to a value of zero, and all unmasked values (such as in regions 24 and 28) to a value of 128. This mask is saved for future reference. This mask, covering the discrete regions 26, is then outwardly dilated four pixels around the circumference of each masked region 26.

The aforementioned magnified image of memory channel 6 is then copied through the dilated mask. This produces an image shown in memory channel 4, having only the continuous network of eroded high basis weight regions 24. The image of memory channel 4 is saved for future reference and classified as to the number of occurrences of each gray level value.

The original mask is copied through a lookup table that reramps gray values from 0–128 to 128–0. This reramping has the effect of inverting the mask. This mask is then inwardly dilated four pixels around the border drawn by the operator. This has the effect of eroding the discrete regions 26.

The magnified image of memory channel 6 is copied through the second dilated mask, to yield the eroded low basis weight regions 28. The resulting image, shown in memory channel 3, is then saved for future reference and classified as to the number of occurrences of each gray level.

In order to obtain the pixel values of the transition regions, the two four pixel wide regions dilated into both the high and low basis weight regions 28, one should combine the two eroded images made from the dilated masks an shown in memory channels 3 and 5. This is accomplished by first loading one of the eroded images into one memory channel and the other eroded image into another memory channel.

The image of memory channel 2 is copied onto the image of memory channel 4, using the image of memory channel 2 as a mask. Because the second image of memory channel 4 was used as the mask channel, only the non-zero pixels will be copied onto the image of memory channel 4. This procedure produces an image containing the eroded high basis weight regions 24, the eroded low basis weight regions 28, but not the nine pixel wide transition regions (four pixels from each dilation and one from the operator's circumscription of the regions 26). This image, shown in memory channel 2, without the transition regions is saved for future reference.

Since the pixel values for the transition regions in the transition region image of memory channel 2 all have a value of zero and one knows the image cannot contain a gray level value greater than 127, (from the subtraction algorithm), all zero values are set to a value of 255. All of the non-zero values from the eroded high and low basis weight regions 28, in the image of memory channel 2 are set to a value of zero. This produces an image which is saved for future reference.

To obtain the gray level values of the transition regions, the image of memory channel 6 is copied through the image of memory channel 5 to obtain only the nine pixel wide transition regions. This image, shown in memory channel 3, is saved for future reference and also classified as to the number of occurrences per gray level.

So that relative differences in basis weight for the low basis weight regions 28, high basis weight regions 24, and transition region can be measured, the data from each of the classified images above and shown in memory channels 3, 5 and 4 respectively are then employed with the regression equation derived from the sample standards. The total mass of any region 24, 26, or 28 is determined by the summation of mass per grey level bin from the image histogram. The basis weight is calculated by dividing the mass values by the pixel area, considering any magnification.

The classified image data (frequency) for each region of memory channels 3–5 and 7 may be displayed as a histogram and plotted against the mass (gray level), with the ordinate as the frequency distribution. If the resulting curve is monomodal the selection of areas and the subjective drawing of the mask were likely accurately performed. The images may also be pseudo-colored so that each color corresponds to a narrow range of basis weights with the following table as the possible template for color mapping.

The image resulting from this proceeding step is then pseudo-colored, based upon the range of gray levels. The following list of gray levels has been found suitable for uncreped samples of cellulosic fibrous structures 20:

| Gray Level Range | Color |
|---|---|
| 0 | Black |
| 1–5 | Dark blue |
| 6–10 | Light blue |
| 11–15 | Green |
| 16–20 | Yellow |
| 21–25 | Red |
| 26+ | White |

Creped samples typically have a higher basis weight than otherwise similar uncreped samples. The following list was found suitable for use with creped samples of cellulosic fibrous structures 20:

| Gray Level Range | Color |
|---|---|
| 0 | Black |
| 1–7 | Dark blue |
| 8–14 | Light blue |
| 15–21 | Green |
| 22–28 | Yellow |
| 29–36 | Red |
| 36+ | White |

The resulting image may be dumped to a printer/plotter. If desired, a cursor line may be drawn across any of the aforementioned images, and a profile of the gray levels developed. If the profile provides a qualitatively repeating pattern, this is further indication that a nonrandom, repeating pattern of basis weights is present in the sample of the fibrous structure 20.

If desired, basis weight differences may be determined by using an electron beam source, in place of the aforementioned soft X-ray. If it is desired to use an electron beam for the basis weight imaging and determination, a suitable procedure is set forth in European Patent Application 0,393,305 A2 published Oct. 24, 1990 in the names of Luner et al., which application is incorporated herein by reference for the purpose of showing a suitable method of determining differences in basis weights of various regions 24, 26 and 28 of the fibrous structure 20.

Variations

Figure 5:
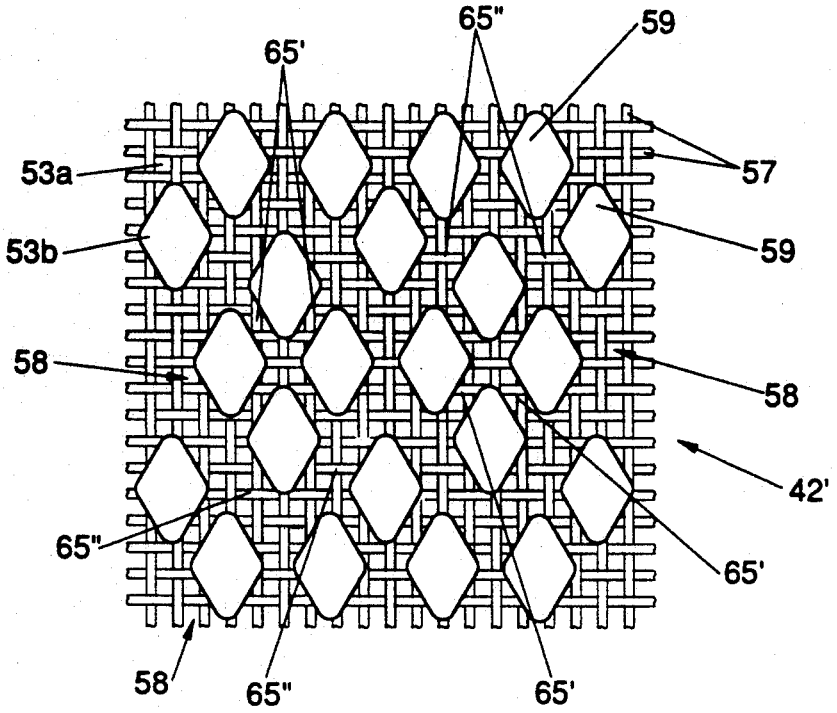
FIG. 5 is a schematic top plan view of an alternative embodiment of a forming element having first protuberances equally spaced from second protuberances by a particular distance, and having first protuberances spaced from third protuberances by a greater distance.

Instead of the cellulosic fibrous structure 20 having discrete intermediate basis weight regions 26, it is prophetically probable that a cellulosic fibrous structure 20 having an essentially continuous network of intermediate basis weight regions 26 may be formed. Such a cellulosic fibrous structure 20 may prophetically be made using a forming belt 42' having protuberances 59 spaced as illustrated in FIG. 5. In the forming belt 42' of FIG. 5, selected protuberances 59 are clustered more closely together so that the liquid pervious annuluses 65' between adjacent protuberances 59 have a lesser hydraulic radius, and hence exhibit more resistance to allowing cellulosic fibers entrained in the liquid carrier to be deposited therein.

Such clusters 58 of selected protuberances 59 are spaced apart from other protuberances 59 which form a separate cluster 58. The liquid pervious annuluses 65'' between adjacent clusters 58 of protuberances 59 have a relatively lesser flow resistance than the liquid pervious annuluses 65' between the more closely spaced protuberances 59. As described above, the clusters 58 of protuberances 59 of the forming belt 42' tesselate and form a nonrandom repeating pattern.

By providing differential spacing between adjacent protuberances 59, liquid pervious annuluses 65' and 65'' having flow resistances inversely proportional to the spacing between the clusters 58 may be acheived the forming belt 42. It is, of course, to be recognized that the basis weights of the regions 24, 26, or 28 of the fibrous structure 20 will still be generally inversely proportional to the flow resistance of any given liquid pervious annulus 65' or 65''.

One expected difference between the fibrous structure 20 produced according the the forming belt 42' of FIG. 5 in the fibrous structure 20 produced according to the forming belt 42 of FIG. 3, is that the fibers of the intermediate basis weight region 26 of the fibrous structure 20 formed according to the forming belt 42', will be generally aligned with the principal directions of the process of manufacture of the fibrous structure 20, rather than being radially oriented with respect to the center of the intermediate basis weight regions 26 or with respect to the low basis weight regions 28.

Figure 6:
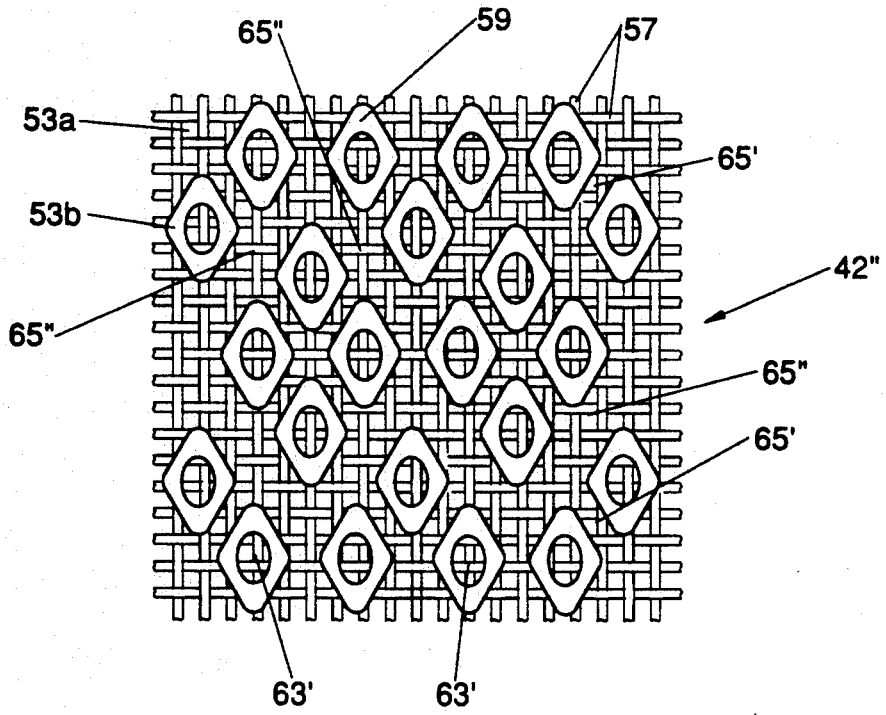
FIG. 6 is a schematic top plan view of an alternative embodiment of a forming belt having protuberances with orifices therethrough and which are clustered in different spacings from adjacent protuberances.

The foregoing means for retaining cellulosic fibers in a pattern in the forming belts 42 and 42' may be combined, as prophetically illustrated in FIG. 6. In FIG. 6, a forming belt 42'' is shown having both adjacent protuberances 59 disposed in clusters so that discrete annuluses 65' and 65'', between adjacent protuberances 59 have different flow resistances. Additionally, the protuberances 59 are provided with apertures 63' having a flow resistance generally equivalent that of the liquid pervious annuluses 65' or 65'' between adjacent protuberances, or which may be different from the flow resistances liquid pervious annuluses 65' or 65'' between adjacent protuberances.

Compound variations are possible. For example, forming belts 42 (not illustrated) having protuberances 59 with orifices 63 of one size in desired protuberances 59 and orifices 63 of a second size (and orifices 63 of yet a third size) in other protuberances are possible. Yet another variation is to incorporate orifices 63 of different sizes into the same protuberance. For example, a diamond shaped protuberance 59 may have two small orifices 63 near the apicies of the diamond shape and a large orifice 63 centered in the diamond shape.

Furthermore, a forming belt 42 (not illustrated) having a cluster of protuberances 59 with one space in between adjacent protuberances, a second spacing between adjacent clusters, and a third spacing between galaxies of adjacent clusters is also possible.

Of course, the compound protuberance 59 spacing variation may be combined with the compound orifice 63 size variation to yield yet further combinations. All such variations and permutations are within the scope of the invention, as set forth by the following claims.

What is claimed is:

1. A single lamina cellulosic fibrous structure comprising a plurality of regions disposed in a nonrandom, repeating pattern:

a first region, of a relatively high basis weight and comprising an essentially continuous network;

a second region of a relatively low or zero basis weight and being circumscribed by and adjacent said first region; and a third region of an intermediate basis weight relative to the basis weight of said first and said second regions, said third region being juxtaposed with said second region.

2. A cellulosic fibrous structure according to claim 1 comprising at least four regions wherein said first region of a relatively high basis weight comprises two relatively high basis weight regions having mutually different densities, each said high basis weight region comprising an essentially continuous network.

3. A cellulosic fibrous structure according to claim 2 comprising at least five regions wherein said first region of a relatively high basis weight comprises two relatively high basis weight regions having mutually different densities and said third region of an intermediate basis weight comprises two intermediate basis weight regions having mutually different densities.

4. A cellulosic fibrous structure according to claim 3 comprising at least six regions wherein said first region of a relatively high basis weight comprises two relatively high basis weight regions having mutually different densities, said third region of an intermediate basis weight comprises two intermediate basis weight regions having mutually different densities and said second region of a low basis weight comprises two low basis weight regions having mutually different densities.

5. A cellulosic fibrous structure according to claim 1 wherein said second region is substantially contiguous with said third region.

6. A cellulosic fibrous structure according to claim 5 wherein said second region is substantially circumjacent said third region.

7. A cellulosic fibrous structure according to claim 1 wherein a plurality of said fibers of said second region are generally radially oriented.

8. A single lamina cellulosic fibrous structure comprising a plurality of regions disposed in a nonrandom, repeating pattern:

a first essentially continuous load bearing network region;

a second discrete region having fewer fibers per unit area than said first region or having zero fibers per unit area; and a third region radially bridging said first network region to said second discrete region.

* * * * *

UNITED STATES PATENT AND TRADEMARK OFFICE

CERTIFICATE OF CORRECTION

PATENT NO. : 5,245,025

DATED : SEPTEMBER 14, 1993

INVENTOR(S) : PAUL D. TROKHAN, DEAN VAN PHAN, LARRY L. HUSTON

It is certified that error appears in the above-identified patent and that said Letters Patent is hereby corrected as shown below:

Column 3, line 51 delete "795,/719" and insert therefor --795,719--.

Signed and Sealed this

First Day of November, 1994

Bruce Lehman

*Attest:*

BRUCE LEHMAN

*Attesting Officer*

*Commissioner of Patents and Trademarks*